US007070686B2

(12) United States Patent
Contolini et al.

(10) Patent No.: US 7,070,686 B2
(45) **Date of Patent: *Jul. 4, 2006**

(54) DYNAMICALLY VARIABLE FIELD SHAPING ELEMENT

(75) Inventors: Robert J. Contolini, Lake Oswego, OR (US); Andrew J. McCutcheon, West Linn, OR (US); Steven T. Mayer, Lake Oswego, OR (US)

(73) Assignee: Novellus Systems, Inc., San Jose, CA (US)

( * ) Notice: Subject to any disclaimer, the term of this patent is extended or adjusted under 35 U.S.C. 154(b) by 642 days.

This patent is subject to a terminal disclaimer.

(21) Appl. No.: 10/274,755

(22) Filed: Oct. 21, 2002

(65) Prior Publication Data

US 2003/0079995 A1 May 1, 2003

Related U.S. Application Data

(63) Continuation-in-part of application No. 10/116,077, filed on Apr. 4, 2002, now Pat. No. 6,755,954, and a continuation-in-part of application No. 09/542,890, filed on Apr. 4, 2000, now Pat. No. 6,514,393, which is a continuation-in-part of application No. 09/537,467, filed on Mar. 27, 2000, now Pat. No. 6,402,923.

(51) Int. Cl.
*C25D 5/00* (2006.01)
*C25D 17/00* (2006.01)

(52) U.S. Cl. ..... 205/96; 205/123; 205/125; 205/157; 205/641; 204/224 R; 204/244 M; 204/212

(58) Field of Classification Search ..... 205/96, 205/123, 125, 157, 641; 204/224 R, 224 M, 204/212
See application file for complete search history.

(56) References Cited

U.S. PATENT DOCUMENTS

| | | | | |
|---|---|---|---|---|
| 4,469,566 | A | 9/1984 | Wray | |
| 5,804,052 | A * | 9/1998 | Schneider | 205/96 |
| 6,228,233 | B1 | 5/2001 | Lakshmikanthan et al. | |
| 6,254,760 | B1 | 7/2001 | Shen et al. | |
| 6,402,923 | B1 * | 6/2002 | Mayer et al. | 205/96 |
| 6,755,954 | B1 * | 6/2004 | Mayer et al. | 205/96 |

* cited by examiner

*Primary Examiner*—Arun S. Phasge
(74) *Attorney, Agent, or Firm*—Thomas Swenson

(57) ABSTRACT

In an electrochemical reactor used for electrochemical treatment of a substrate, for example, for electroplating or electropolishing the substrate, one or more of the surface area of a field-shaping shield, the shield's distance between the anode and cathode, and the shield's angular orientation is varied during electrochemical treatment to screen the applied field and to compensate for potential drop along the radius of a wafer. The shield establishes an inverse potential drop in the electrolytic fluid to overcome the resistance of a thin film of conductive metal on the wafer.

27 Claims, 8 Drawing Sheets

FIG. 13
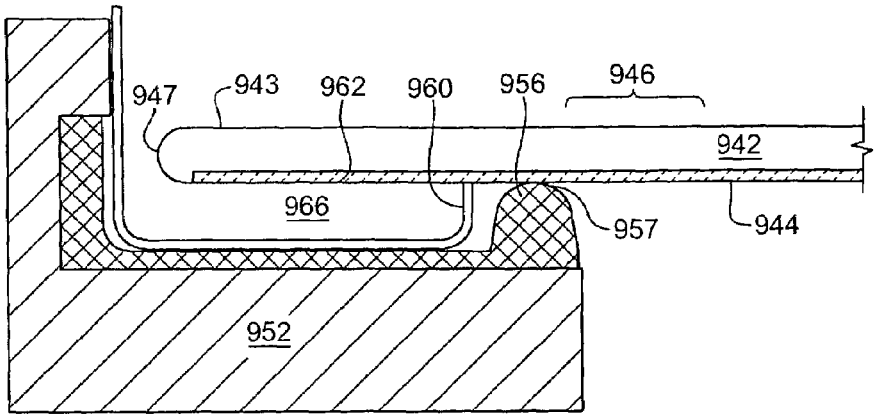
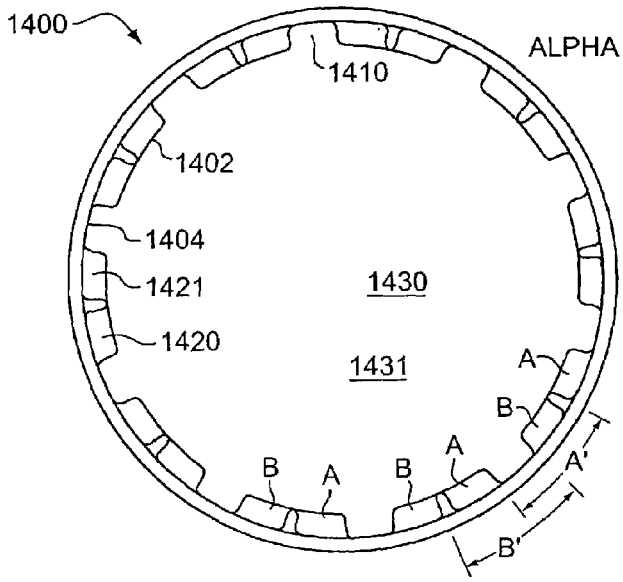
FIG. 14

DYNAMICALLY VARIABLE FIELD SHAPING ELEMENT

RELATED APPLICATIONS

This application is a continuation-in-part application under 37 CFR 1.53(b) U.S. patent application Ser. No. 09/542,890 filed Apr. 4, 2000 now U.S. Pat. No. 6,514,393, which is hereby incorporated by reference. This application is also a continuation-in-part application under 37 CFR 1.53(b) of U.S. patent application Ser. No. 10/116,077 filed Apr. 4, 2002 now U.S. Pat. No. 6,755,954, which is hereby incorporated by reference and which is a continuation-in-part application of U.S. patent application Ser. No. 09/537,467 filed Mar. 27, 2000, which issued as U.S. Pat. No. 6,402,923 B1 on Jun. 11, 2002 to Mayer et al.

FIELD OF THE INVENTION

The present invention pertains to the field of electrochemical treatment and particularly to electroplating and electropolishing of integrated circuit substrate wafers and electronic memory storage devices, such as magnetic disks.

BACKGROUND OF THE INVENTION

Integrated circuits are formed on wafers by well-known processes and materials. These processes typically include the deposition of thin film layers by sputtering, metal-organic decomposition, chemical vapor deposition, plasma vapor deposition, and other techniques. These layers are processed by a variety of well-known etching technologies and subsequent deposition steps to provide a completed integrated circuit.

A crucial component of integrated circuits is the wiring or metallization layer that interconnects the individual circuits. Conventional metal deposition techniques include physical vapor deposition, e.g., sputtering and evaporation, and chemical vapor deposition techniques. Some integrated circuit manufacturers are investigating electrodeposition techniques to deposit primary conductor films on semiconductor substrates.

Wiring layers have traditionally been made of aluminum and a plurality of other metal layers that are compatible with the aluminum. In 1997, IBM introduced technology that facilitated a transition from aluminum to copper wiring layers. This technology has demanded corresponding changes in process architecture towards damascene and dual damascene architecture, as well as new process technologies.

Copper damascene circuits are produced by initially forming trenches and other embedded features in a wafer, as needed for circuit architecture. These trenches and embedded features are formed by conventional photolithographic processes. A barrier layer, e.g., of silicon nitride, is deposited next. An initial seed or strike layer generally less than 125 nm (nanometers) thick is then deposited by a conventional vapor deposition technique, and this seed layer is typically a thin conductive layer of copper or tungsten. The seed layer is used as a base layer to conduct current for electroplating thicker films. Thinner seed layers are preferred so as to reduce overhang and closure of very small features with metal from the seed layer. The seed layer functions as the cathode of the electroplating cell as it carries electrical current between the edge of the wafer and the center of the wafer including filling of embedded structures, trenches or vias. The final electrodeposited thick film should completely fill the embedded structures, and it should have a uniform thickness across the surface of the wafer.

Generally, in electroplating processes, the thickness profile of the deposited metal is controlled to be as uniform as possible. This uniform profile is advantageous in subsequent etchback or polish removal steps, as well as uniform void-free filling of the trench structures. Prior art electroplating techniques are susceptible to thickness irregularities. Contributing factors to these irregularities are recognized to include the size and shape of the electroplating cell, electrolyte depletion effects, hot edge effects and the terminal effect.

For example, because the seed layer is initially very thin, the seed layer has a significant resistance radially from the edge to the center of the wafer. This resistance causes a corresponding potential drop from the edge where electrical contact is made to the center of the wafer. Thus, the seed layer has a nonuniform initial potential that is more negative at the edge of the wafer. The associated deposition rate tends to be greater at the wafer edge relative to the interior of the wafer. This effect is known as the "terminal effect".

One solution to the end effect would be to deposit a thicker seed layer having less potential drop from the center of the wafer to the edge; however, thickness uniformity of the final metal layer is also impaired if the seed layer is too thick. FIG. 1 shows a prior art seed layer 100 made of copper formed atop barrier layer 102 and a dielectric wafer 104. A trench or via 106 has been cut into wafer 104. Seed layer 100 thickens in mouth region 108 with thinning towards bottom region 110. The thickness of seed layer 100 is a limiting factor on the ability of this layer to conduct electricity in the amounts that are required for electroplating operations. Thus, during electrodeposition, the relatively thick area of seed layer 100 at mouth region 108 grows more rapidly than does the relatively thin bottom region 110 with the resultant formation of a void or pocket in the area of bottom region 110 once mouth region 108 is sealed.

FIG. 2 shows an ideal seed layer 200 made of copper formed atop barrier layer 202 and a dielectric wafer 204. A trench or via 206 has been cut into wafer 204. Ideal seed layer 200 has three important properties:

1. Good uniformity in thickness and quality across the entire horizontal surface 208 of wafer 204;
2. Excellent step coverage exists in via 206 consisting of continuous conformal amounts of metal deposited onto the sidewalls; and
3. In contrast to FIG. 1, there is minimal necking in the mouth region 210.

It is difficult or impossible to obtain these properties in seed layers having a thickness greater than about 120 nm to 130 nm.

The electroplating of a thicker copper layer should begin with a layer that approximates the ideal seed layer 200 shown in FIG. 2. The electroplating process will exacerbate any problems that exist with the initial seed layer due to increased deposition rates in thicker areas that are better able to conduct electricity. The electroplating process must be properly controlled or else thickness of the layer will not be uniform, there will develop poor step coverage, and necking of embedded structures can lead to the formation of gaps of pockets in the embedded structure.

A significant part of the electroplating process is the electrofilling of embedded structures. The ability to electrofill small, high aspect ratio features without voids or seams is a function of many parameters. These parameters include the plating chemistry; the shape of the feature including the width, depth, and pattern density; local seed layer thickness; local seed layer coverage; and local plating current. Due to the requisite thinness of the seed layers to avoid necking and for other reasons as discussed above, a significant potential difference exists between the center of a wafer and the edges of a wafer. Poor sidewall coverage in embedded structures, such as trench 106 in FIG. 1, develops higher average resistivity for current traveling in a direction that is normal to the trench. Due to these factors in combination, the range of current densities in which void free filling can be obtained over the entire wafer is limited. In extreme cases (e.g., with very small features and/or thin seed layers), there is practically no set of operating conditions for filling to occur both at the wafer center and its edge.

Manufacturing demands are trending towards circumstances that operate against the goal of global electrofilling of embedded structures and thickness uniformity. Industry trends are toward thinner seed films, larger diameter wafers, increased pattern densities, and increased aspect ratio of circuit features. The trend toward thinner seed layers is required to compensate for an increased percentage of necking in smaller structures, as compared to larger ones. For example, FIG. 3 shows a comparison between etched versus seeded features for a HCM PVD process. A 45° line is drawn to show no necking, but the data shows necking as the seeded feature width rolls downward in the range from 0.3 μm to 0.15 μm.

Regarding the trend towards larger diameter wafers, it is generally understood that the deposition rate, as measured by layer thickness, can be maintained by scaling total current through the electrochemical reactor in proportion to the increased surface area of the larger wafer. Thus, a 300 mm (millimeter) wafer requires 2.25 times more current than does a 200 mm wafer. Electroplating operations are preferably performed by using a clamshell-type wafer holder that contacts the wafer only at its outer radius. Due to this mechanical arrangement, the total resistance from the edge of the wafer to the center of the wafer is proportional to the radius. Nevertheless, with the higher applied current at the edge of the larger wafer, which is required to maintain the same current density for process uniformity, the total potential drop from the edge to the center of the wafer is greater for the larger diameter wafer. This circumstance leads to an increased rate of deposition that increases with radius where deposition is measured by layer thickness. While the problem of increasing deposition rate with radius exists for all wafers, it is exacerbated in the case of larger wafers.

U.S. Pat. No. 4,469,566 issued Sep. 4, 1984 to Daniel X. Wray teaches electroplating of a paramagnetic layer with use of dual rotating masks each having aligned aperture slots. Each mask is closely aligned with a corresponding anode or cathode. The alternating field exposure provides a burst of nucleation energy followed by reduced energy for a curdling effect. The respective masks and the drive mechanism are incapable of varying the distance between each mask and its corresponding anode or cathode, and they also are incapable of varying the masked surface area of their corresponding anode or cathode.

U.S. Pat. No. 5,804,052 issued Sep. 8, 1998 to Reinhard Schneider teaches the use of rotating roller-shaped bipolar electrodes that roll without short circuit across the surface being treated in the manner of a wiper.

The foregoing discussion describes electroplating operations and focuses upon the problems that arise from thin film seed layers and the necessity of using increasingly thin seed layers. In electroplating operations, the wafer is connected and used as a cathode or the negative terminal of the electrochemical reactor. Similar problems arise in electropolishing operations where the wafer or another object is connected for use as the anode to remove rough features, e.g., from the surface of a magnetic disk for use in a computer hard drive. Portions of the film are preferentially removed in a radially outboard direction.

None of the aforementioned patents overcome the special problems related to potential drop and current density in electrochemical operations, in particular, in electroplating and electropolishing of metal thin films. There exists a need to compensate the potential drop in conductive metal films while electroplating or electropolishing these films to facilitate the production of layers having uniform thicknesses and global electrofilling of embedded features.

SUMMARY OF THE INVENTION

The present invention helps to solve some of the problems outlined above by providing a time variable field shaping element, i.e., a mask or shield, that is placed in the electrochemical reactor to compensate for the potential drop across a metal layer on the substrate surface being treated. The shield compensates for the potential drop in the metal layer by shaping an inverse resistance drop in the electrolyte to achieve a uniform current distribution.

In a method and an apparatus in accordance with the invention, an electrochemical reactor having a variable field-shaping capability is utilized in electroplating, electropolishing and other electrochemical treatments of integrated circuit substrates. The electrochemical reactor typically includes a reservoir that retains an electrolytic fluid. A cathode and an anode are disposed in the reservoir to provide an electrical pathway through the electrolytic fluid. A wafer-holder contacts one of the anode and the cathode. In one aspect, a selectively actuatable shield is positioned in the electrical pathway between the cathode and the anode for varying an electric field around the wafer-holder during electrochemical operations, such as electroplating and electropolishing.

The shield can have many forms. A mechanical iris may be used to change the size of the aperture, or a strip having different sizes of apertures may be shifted to vary the size of aperture that is aligned with the wafer. The shield may be raised and lowered to vary a distance that separates the shield from the wafer. The wafer or the shield may be rotated to average field inconsistencies that are presented to the wafer. The shield may have a wedge shape that screens a portion of the wafer from an applied field as the wafer rotates. The shield may also be tilted to present more or less surface area for screening effect.

More specifically, a specialized mask or shield is used to vary the electric field at the wafer during the electrochemical treatment to balance the potential drop in a desired manner across a metal film on the substrate being treated and to control current density in the metal film.

In one aspect, an embodiment in accordance with the invention provides a flange or object-holding device having a variable field shaping element, in particular, an inflatable bladder, that is placed in the electrochemical reactor to compensate for the potential drop in a thin conductive film during electroplating and electropolishing operations. The shield compensates for this potential drop by shaping an inverse potential drop in the electrolyte to achieve a uniform current distribution on the surface of the object being plated or polished.

In one aspect, a flange in accordance with the invention is used to hold objects including semiconducting wafers, magnetic disks and the like in an electrochemical reactor. The flange provides an ability to control field potential at the surface of the object being held for more uniform electrochemical results, such as the thickness of an electroplated metal layer, or the smoothness of an electropolished metal layer. In another aspect, a flange includes three primary sections, which may be bonded together, bolted, or integrally formed.

In one aspect, an object-retaining segment establishes electrical contact with the margins of a wafer, magnetic disk, or other object. The object-retaining segment holds the object to present a surface of the object for electrochemical reaction. In another aspect, an inflatable elastomeric bladder is disposed around the object-retaining segment in a manner permitting selective inflation and deflation of the bladder. The bladder shields corresponding surface area on an object held in the object-retaining segment from electric field potential. In still another aspect, an intermediate segment separates the object-retaining segment from the inflatable bladder to prevent the inflatable bladder from damaging objects held in the object-retaining segment.

In preferred embodiments, the intermediate section has at least one hole permitting gas to escape from between the object-retaining segment and the inflatable bladder. The flange is preferably formed of two bivalve halves each formed in a semicircle or in a 180° arc. The halves slide together to form a circle.

In operation, the flange is placed in an electrochemical reactor between a cathode and an anode. Current flows through an electrolytic fluid in the reactor for electropolishing or electroplating operations. A computer uses a pressurized gas source and controls electrically actuated vales to continuously adjust the position of the inflatable bladder for the purpose of maintaining a constant current density across the surface of the wafer, magnetic disk, or other object held in the object retaining segment.

In addition to being useful in a wide variety of electroplating operations, embodiments in accordance with the invention are generally useful in numerous types of electrochemical operations, especially during manufacture of integrated circuits. For example, embodiments are useful in various electrochemical removal processes, such as electroetching, electropolishing, and mixed electroless/electroremoval processing. In the claims below, the term "electropolishing" is used broadly to include electrochemical removal processes generally.

Embodiments in accordance with the invention are described below mainly with reference to apparati and methods for electroplating substrate wafers. Nevertheless, the terms "electrochemical treatment", "electrochemically treating" and related terms as used herein refer generally to various techniques, including electroplating operations, of treating the surface of a substrate in which the substrate or a thin film of conductive material on the substrate functions as an electrode.

The adjectival terms "variable", "dynamic", "dynamically variable" and similar terms herein generally mean that a dimensional or operational variable or parameter of an apparatus or method is selectively changed during the treatment of a wafer. In particular, a variable or parameter is dynamically varied to shape an electric field and thereby to accommodate the changing electrical properties of a deposited metal layer as layer thickness increases (or decreases in layer removal treatments) during electrochemical treatment operations. The term "time-variable" and similar terms are used more or less synonymously with terms such as "dynamic".

BRIEF DESCRIPTION OF THE DRAWINGS

FIG. 13 depicts in schematic form the disposition of wafer substrate in a cup of a clamshell substrate holder; and FIG. 14 depicts an alpha-type diffuser shield in accordance with the invention constructed using two rotatable rings with overlapping open and closed areas.

DETAILED DESCRIPTION OF PREFERRED EMBODIMENTS

Figure 1:
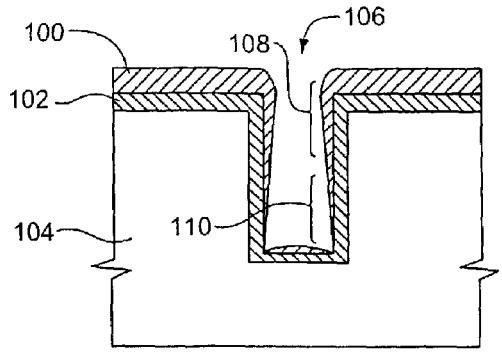
FIG. 1 PRIOR ART
FIG. 1 depicts a prior art seed layer deposited on a wafer, forming an undesirable necked feature at the mouth of a trench.

The invention is described herein with reference to FIGS. 1–14. It should be understood that the structures and systems depicted in schematic form in FIGS. 4–14 are used to explain the invention and are not precise depictions of actual structures and systems in accordance with the invention. Furthermore, the preferred embodiments described herein are exemplary and are not intended to limit the scope of the invention, which is defined in the claims below.

Embodiments in accordance with the invention compensate for electrical resistance and voltage drop across the wafer, particularly during phases of electrochemical treatment when the conductive metal film at the treatment surface of the substrate is especially thin; for example, at the beginning of an electroplating process when the thin seed layer dominates current flow and voltage drop, or in later stages of an electropolishing operation. Such compensation is generally conducted by shaping a potential drop in the electrolyte bath corresponding but inverse to the electrical resistance and voltage drop across the wafer substrate, thereby achieving a uniform (or tailored, if desired) current distribution. As the electroplated layer becomes thicker and the terminal effect decreases, preferred embodiments in accordance with the invention effect a transition to a uniform plating distribution by dynamically varying the electrical field and current source that the wafer experiences.

Electropolishing is a process whereby metal is removed from a micro-rough surface and is "polished" to produce an optically smooth surface. Sharp top edges of features and raised regions will etch faster than the recessed features. In embodiments in accordance with the invention, a metal film on the substrate surface is typically maintained at a positive voltage (relative to a reference voltage) and serves as the anode, and another electrode is maintained at a negative voltage relative to the anode (or to the reference voltage). An electrolytic, electropolishing fluid causes anodic dissolution of metal at the substrate surface.

In this specification, the terms "anode" and "cathode" refer to structures at which an oxidation and reduction process occur, respectively. In descriptions of the apparatus with reference to a plating operation, the term cathode refers to the workpiece, and anode refers to the counter-electrode. In the context of electropolishing, the nomenclature is reversed, so that the wafer is the anode and the counter-electrode is the cathode. Generally, only one of the two processes are described for a particular apparatus arrangement. Nevertheless, it is understood that the context described (plating or polishing) does not limit the scope of the invention in its application to either type of process.

The amount of metal removed in an electropolishing operation typically depends on feature sizes. In a planarization process, which is a common electropolishing operation, the degree of planarization is typically expressed as the size of features that are smoothed. For example, the electropolishing removal of metal within dielectric features that are initially as wide as they are deep, which is a 1:1 feature ratio, typically results in a final nonuniformity (i.e., depression) in the metal film relative to the planarized surface of less than $1/20^{th}$ of the width of the feature, that is, a final feature ratio of 1:20. (Contolini, R. J., et al, *J. Electrochemical Society,* vol. 141, no. 9, pp 2503–2510, (1994)).

In certain embodiments in accordance with the invention for conducting electrochemical treatments, for example, electroplating and electropolishing, the uniformity of metal thickness from the edge of a substrate wafer to its center is influenced by varying during the electrochemical operation an adjustable flange to different ring-widths covering the circumference region of the wafer. This circumferential, inflatable and deflatable outer ring, being close to the wafer surface (less than 10 mm), restricts and, therefore, lowers the electric field and current density at the wafer edge. This effect improves the edge-to-center metal-thickness uniformity of electroplating and electropolishing.

Figure 4:
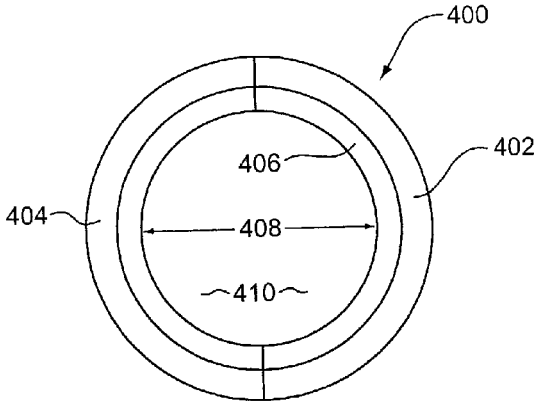
FIG. 4 depicts a first embodiment of a flange having an inflatable bladder having two bivalve halves in accordance with the invention.

FIG. 4 depicts a bottom view of a wafer-holding device 400 in accordance with the invention. Wafer-holding device 400 is made of two bivalve halves 402 and 404 with one half being a mirror image of the other. Each half has an inflatable bladder, e.g., half 402 has bladder 406. Bladder 406 is deflated to a relaxed position corresponding to diameter 408 superimposed over an overlying wafer 410 that is retained in halves 402 and 404.

Figure 5:
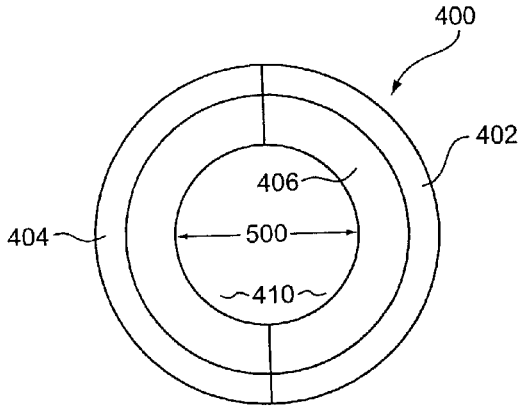
FIG. 5 depicts the flange of FIG. 4 with the bladder inflated to a second position.

FIG. 5 depicts wafer-holding device 400 with bladder 406 inflated to occupy a decreased diameter 500 that covers or shields increasingly more of overlying wafer 500.

Figure 6:
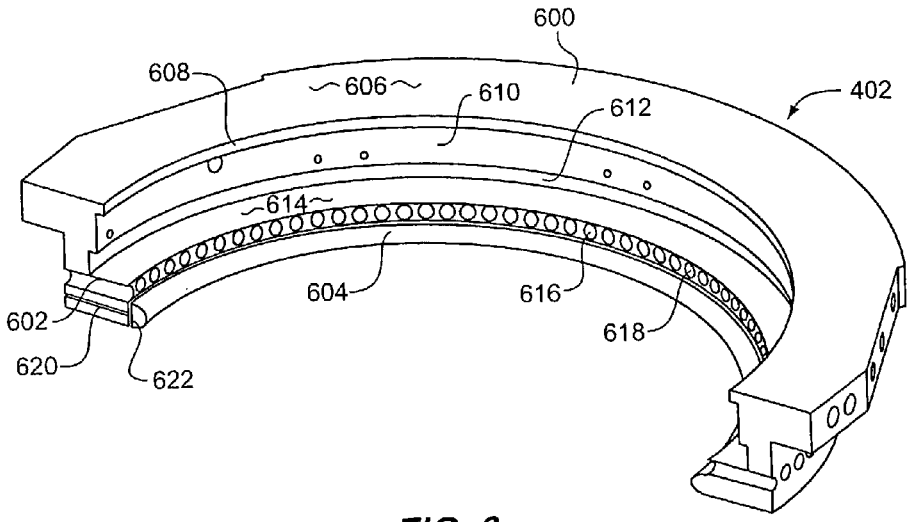
FIG. 6 depicts a half of the flange shown in FIGS. 4 and 5.

FIG. 6 depicts bivalve half 402 in additional detail. The main components of half 402 are three integrally formed sections including a wafer-holding section 600, an intermediate section 602 and an inflatable bladder 604. The wafer-holding section 600 includes a top surface 606 leading to a radially inboard lip 608, which falls to a vertical section 610 of increased radial diameter. The projection of lip 608 in this manner permits mechanical binding of section 600 with corresponding structure for mounting half 402 in an electrochemical reactor in the intended environment of use. A radial channel 612 has an increased radius with respect to vertical section 610 and can be used to retain a substrate against intermediate section 602; for example, a semiconductor wafer substrate for electroplating operations, or a magnetic disk for electropolishing operations.

Intermediate section 602 includes a wall 614 of decreased radius with respect to channel 612 and vertical section 610. A plurality of holes, e.g., holes 616 and 618, extend through wall 614 to permit the escape of trapped gas that could, otherwise, interfere with electrochemical reaction at the surface of a wafer to be held in half 402. Gas transit pathways for inflation and deflation of bladder 604, e.g., bladder purge path 620, are formed into wall 614 for the ingress and egress of gas. The lower perimeter of wall 614 contains a recess corresponding to the outer diameter of bladder 604 for the retention of bladder 604 therein. In another preferred embodiment, a single slot is used instead of a series of holes 616 and 618. This embodiment leads to a more azimuthally-uniform removal rate because it avoids perturbations in the flow patterns in and around the hole entrances.

Bladder 604 is fabricated using a material selected from a large group of commercially available materials that are resistant to corrosion by electrolytic fluids and are suitably flexible; for example, materials comprising silicone, Viton, Kevlar, and EPDM. Custom-made inflatable bladders comprising suitable bladder material are commercially available, for example, from Seal Master Corp., Kent, Ohio, USA. The bladder material typically has a thickness in a range of about from 0.1 mm to 1 mm. The bladder typically is filled with inert or relatively non-reactive gas, such as argon, helium or nitrogen. During electrochemical treatments conducted at substantially atmospheric pressure, the gas inside the bladder typically has a pressure in a range of about from 0.1 atm to 4 atm. Preferably, a small suction pump is used when deflating the bladder.

Figure 7:
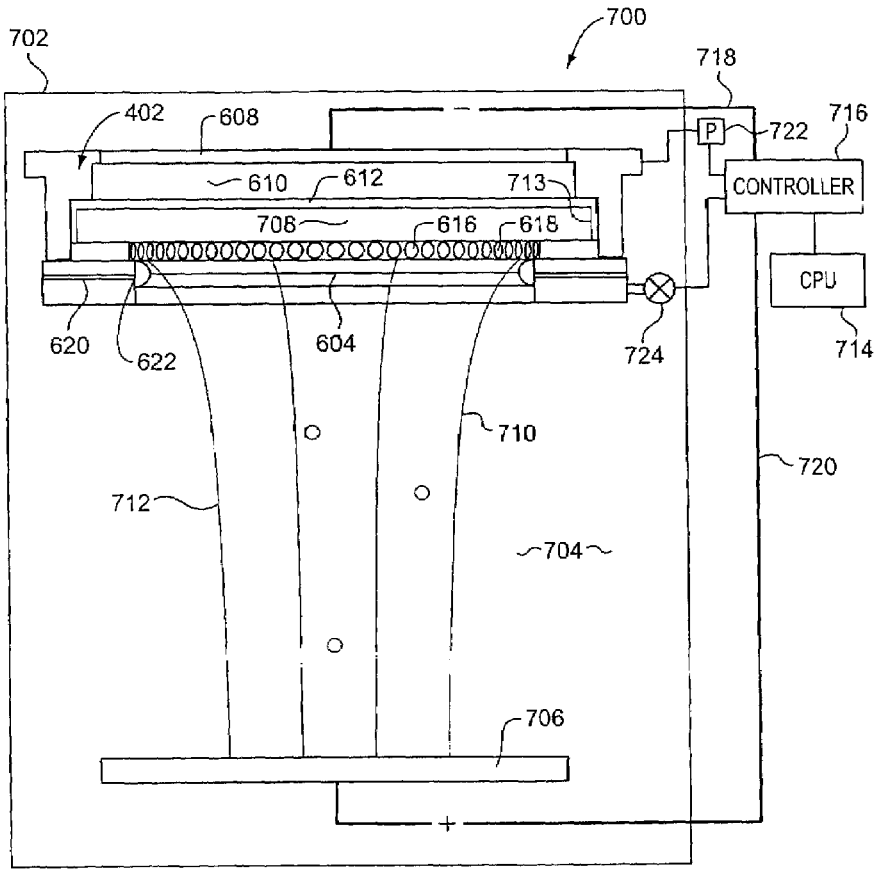
FIG. 7 depicts an electrochemical reactor with the flange shown in FIGS. 4 and 5 installed therein.

FIG. 7 depicts an electrochemical reactor 700 with wafer-holding device 400 represented by bivalve half 402. Electrochemical reactor 700 includes a reservoir 701 that contains an electrolytic fluid 702 for use in performing electroplating reactions. This electrolytic fluid 702 can, for example, include a copper carboxylate or copper alkoxide in combination with cupric ammonium salts to enhance electrical conductivity. An anode 706 is typically made of the metal being plated. Bivalve half 402 contacts wafer 708 to serve as a wafer-holder to place wafer 708 in position for use as a cathode in electrochemical reactor 700. A plurality of field lines, e.g., such as the field represented by lines 710 and 712, extend from anode 706 to bivalve half 402. The polarity of electrochemical reactor 700 may be reversed for electropolishing operations, namely, to place a negative charge on anode 706 to convert anode 706 to the cathode with a corresponding positive charge on bivalve half 402 making bivalve half 402 the anode. Operation of bivalve half 402 as a positively charged anode and of opposite electrode 706 as a negatively charged cathode causes the copper to dissolve from wafer 708 into solution.

Field lines 710 and 712 show the mechanism that bladder 604 uses to compensate for the radial drop in potential across the surface of wafer 708. Field lines 710 and 712 curve towards outer radius 713 of wafer 708 to provide an inverse potential drop in electrolytic fluid 704, which compensates for the potential drop by the diameter of bladder 604. Thus, the current is concentrated at the center of the wafer, which is in vertical alignment with bladder 604.

The potential drop along the surface of wafer 708 changes with time as the copper plating on wafer 708 increases in thickness. The increased thickness reduces the total potential drop in the copper. There is a corresponding need to inflate or deflate bladder 604 in a continuous manner to offset the variable potential drop along the surface of wafer 704. This movement is accomplished by a central processor 714 and a controller 716. Central processor 714 monitors the current and voltage on lines 718 and 720 using signals provided by controller 716. Central processor 714 interprets these signals and causes a corresponding reduction or increase in the diameter of bladder 604 by injecting gas from pressurized source 722 to increase the diameter of bladder 604, or opening electronically actuated valve 724 to reduce the diameter. Processor 714 is programmed to interpret these signals by the use of a neural network or an adaptive filter using a set of measurements over time corresponding to actual thickness measurements over the surface of wafer 708. Alternatively, a set of synthetic data may be created from mathematical modeling for this purpose using conventional equations to model the projection of a field through an electrolyte, or the mathematical model itself may be solved to adjust the diameter of bladder 604.

Figure 2:
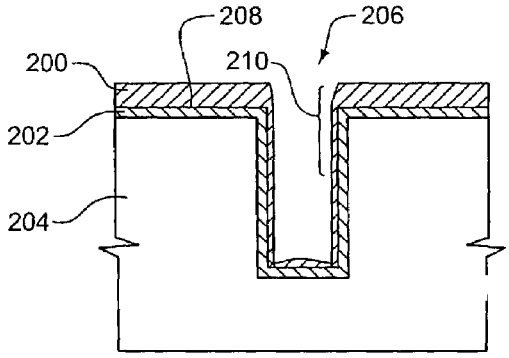
FIG. 2 PRIOR ART
FIG. 2 depicts an ideal seed layer that is deposited to provide uniform coverage across a trench feature, as well as on the surface of the wafer.
Figure 3:
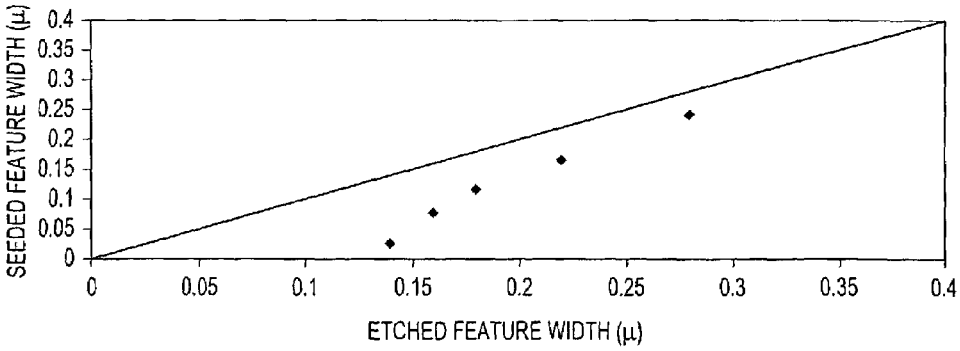
FIG. 3 PRIOR ART
FIG. 3 shows data from a HCM PVD process demonstrating rolloff in a comparison between etched feature width and seeded feature width that indicates necking as a percentage of feature width increases as the etched feature width decreases.
Figure 8:
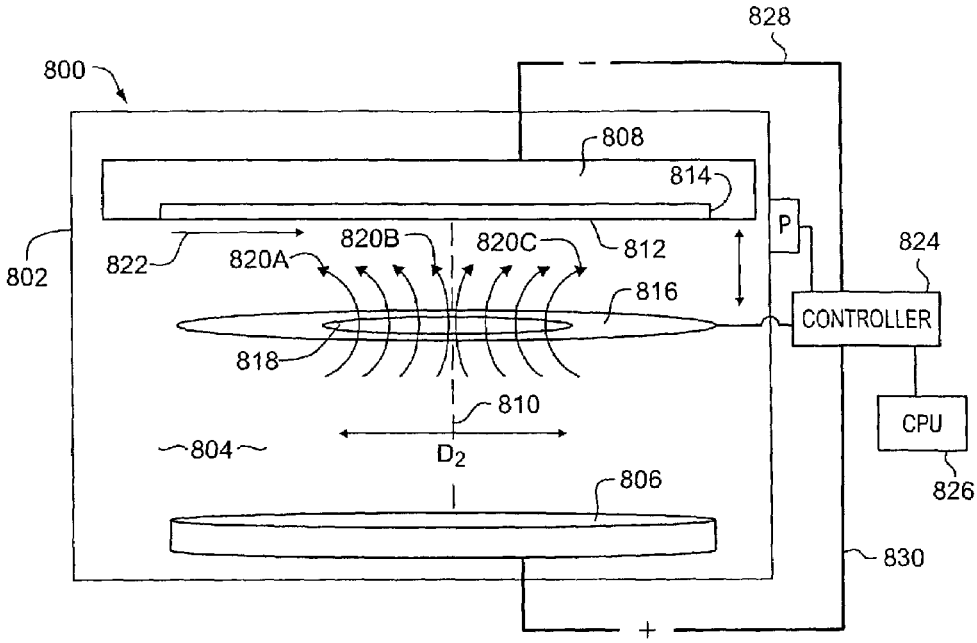
FIG. 8 depicts an embodiment of an electrochemical reactor in accordance with the invention in which the shield is constructed as a mechanical iris.

FIG. 8 depicts an electrochemical reactor 800 in accordance with the invention. A reservoir 802 contains a conventional electrolytic fluid or electroplating bath 804. An anode 806 and a cathode 808 establish an electrical pathway 810 through electrolytic fluid 804. Anode 806 is typically made of the metal being plated, which is compatible with electrolytic fluid 804 and is preferably copper for purposes of the invention. It can also be composed of a nonreactive or dimensionally stable anode, such as Pt, Ti, or other materials known in the art. As shown in FIG. 8, cathode 808 is formed as a clamshell-holding device that retains wafer 812 by placing the wafer in electrical contact with cathode-wafer holder 808 only at the outer radius 814 of wafer 812. Anode/wafer holder 808 also rotates as a turntable by the action of a mechanical drive mechanism M in preferred embodiments for the purpose of averaging field variances that are presented to wafer 812 during electroplating operations. Wafer 812 may be any semiconducting or dielectric wafer, such as silicon, silicon-germanium, ruby, quartz, sapphire, and gallium arsenide. Prior to electroplating, wafer 812 is preferably a silicon wafer having a copper seed layer 200 atop a Ta or Ti nitride barrier layer 202 with embedded features 206, as shown in FIG. 2.

A mechanical shield 816 is placed in electrical pathway 810. This particular shield 816 presents a circular iris or aperture 818. The structural components for the manufacture of mechanical shield 814, as well as its method of operation, are known in the art of camera manufacturing where a plurality of overlapping elongated elements (not depicted in FIG. 8) are interconnected to form a substantially circular central opening that varies depending upon the azimuthal orientation of the respective elongated elements. Shield 816 is made of materials that resist attack by electrolytic fluid 804. These materials are preferably high dielectrics or a composite material including a coating of a high dielectric to prevent electroplating of metal onto shield 816 due to the induced variation in potential with position of the shield within the bath. Plastics may be used including polypropylene, polyethylene, and fluoro-polymers, especially polyvinylidine fluoride.

A plurality of field lines 820*a*, 820*b*, and 820*c* show the mechanism that shield 816 uses to compensate for the radial drop in potential across the surface of wafer 812 along radial vector 822. Due to the fact that shield 816 prevents the passage of current along electrical pathway 810 except through iris 818, field lines 820*a*–820*c* curve towards outer radius 814 to provide an inverse potential drop in electrolytic fluid 804 compensating for the potential drop along radial vector 822. Thus, the current is concentrated at the center of the wafer, which is in vertical alignment with iris 818. The potential drop along radial vector 822 changes with time as the copper plating on wafer 812 increases in thickness. The increased thickness reduces the total potential drop in the copper following radial vector 822.

There is a corresponding need to move or change the shape of shield 816 in a continuous manner to offset the variable potential drop along radial vector 822. This movement can be accomplished, among others, by one of two exemplary mechanisms that are implemented by a controller 824 and a central processor 826. According to a first mechanism, controller 822 increases the diameter $D_2$ of iris 818 to provide a more direct route to the wafer with less curvature of field lines 820*a*–820*c* along electrical pathway 810. According to a second mechanism, controller 824 injects a neutral pressurized gas from a source P into reservoir 802. Shield 816 contains an air bladder or trapped bubbles (not depicted in FIG. 8) that withstand a reduction in volume due to the increase in pressure. Shield 814 loses buoyancy and, consequently, falls relative to wafer 812 with an increase in dimension 825 separating wafer 812 from shield 816. The increase in dimension 825 requires field lines 820*a*–820*c* to bend less sharply before contacting wafer 812 with the corresponding effect of concentrating less current at the center of wafer 812. Alternatively, a mechanical drive mechanism (not depicted in FIG. 8) may be used to raise and lower shield 812 to vary dimension 825 separating shield 816 from wafer 812.

Figure 9:
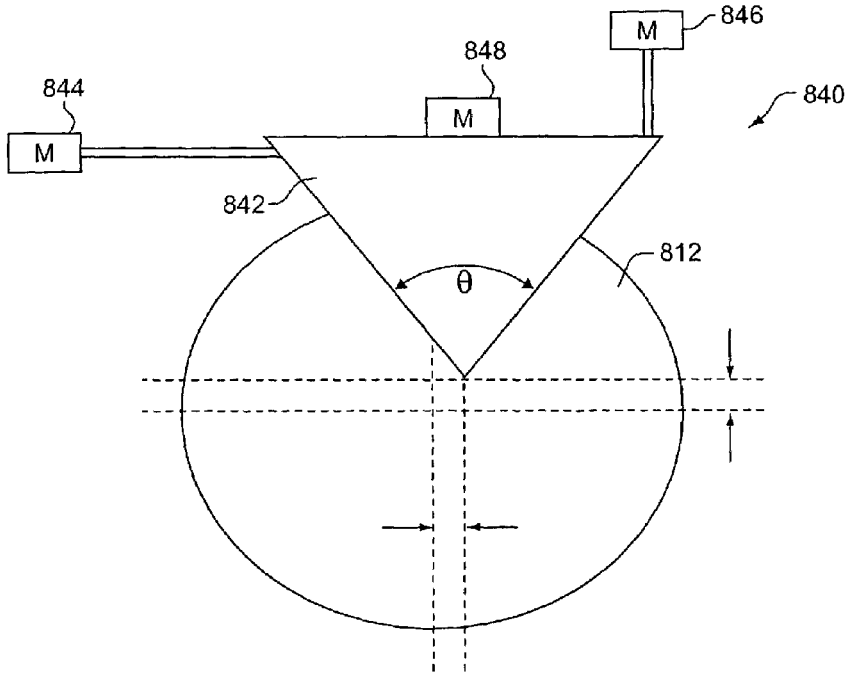
FIG. 9 depicts an embodiment of an electrochemical reactor in accordance with the invention where the shield is constructed as a wedge having a three dimensional range of motion.

FIG. 9 depicts another embodiment in accordance with the invention, including an electrochemical reactor 840. Electrochemical reactor 840 is identical to electrochemical reactor 800, except for differences between a wedge-shaped shield 842 and iris shield 814 (see FIG. 8). For simplicity, in FIG. 9, only wedge-shaped shield 842 is depicted in relationship to wafer 812 from a bottom view on electrical pathway 810. Wedge-shaped shield 842 is formed as an isosceles triangle presenting an angle θ towards the central portion of wafer 812. A pair of stepper motor-driven screw assemblies 844 and 846 are actuated by controller 824 to impart X and Y motion to wedge-shaped shield 842. Thus, a relatively larger or relatively smaller surface area of wafer 812 is screened from the applied field by X-Y motion of wedge-shaped shield 842. A third stepper motor-screw assembly (not depicted in FIG. 8) may be provided to impart a Z range of motion in a third dimension.

Figure 10:
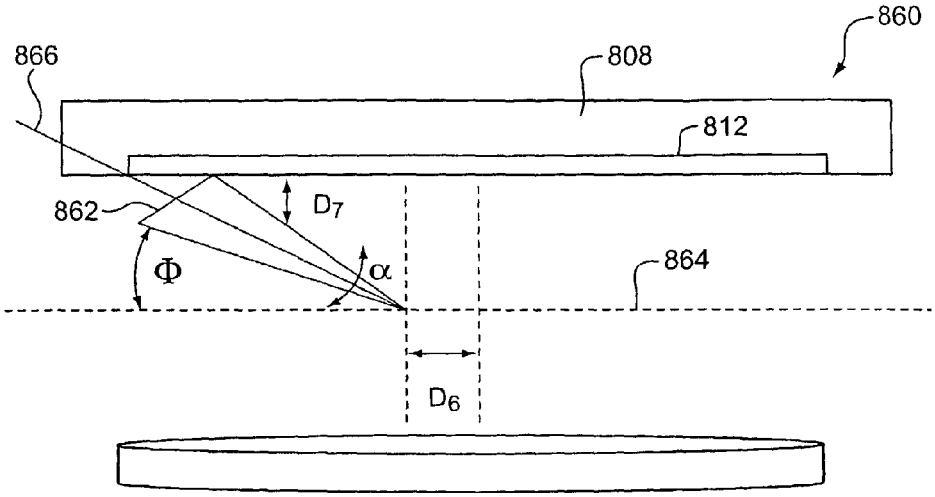
FIG. 10 depicts an embodiment of an electrochemical reactor in accordance with the invention where the shield is constructed as a wedge that may be tilted and rotated.

FIG. 10 depicts from a side elevational view of an embodiment in accordance with the invention including an electrochemical reactor 860. Electrochemical reactor 860 is identical to electrochemical reactor 800, except for differences between wedge-shaped shield 862 and wedge-shaped shield 842. Wedge-shaped shield 862 differs from wedge-shaped shield 842 because wedge-shaped shield 862 is canted at an angle φ determined with respect to a line 862 running parallel to a chord taken across wafer 812. Wedge-shaped shield 862 may also be rotated at an angle α about an axis 864 to vary the surface area that is presented to wafer 812.

Figure 11:
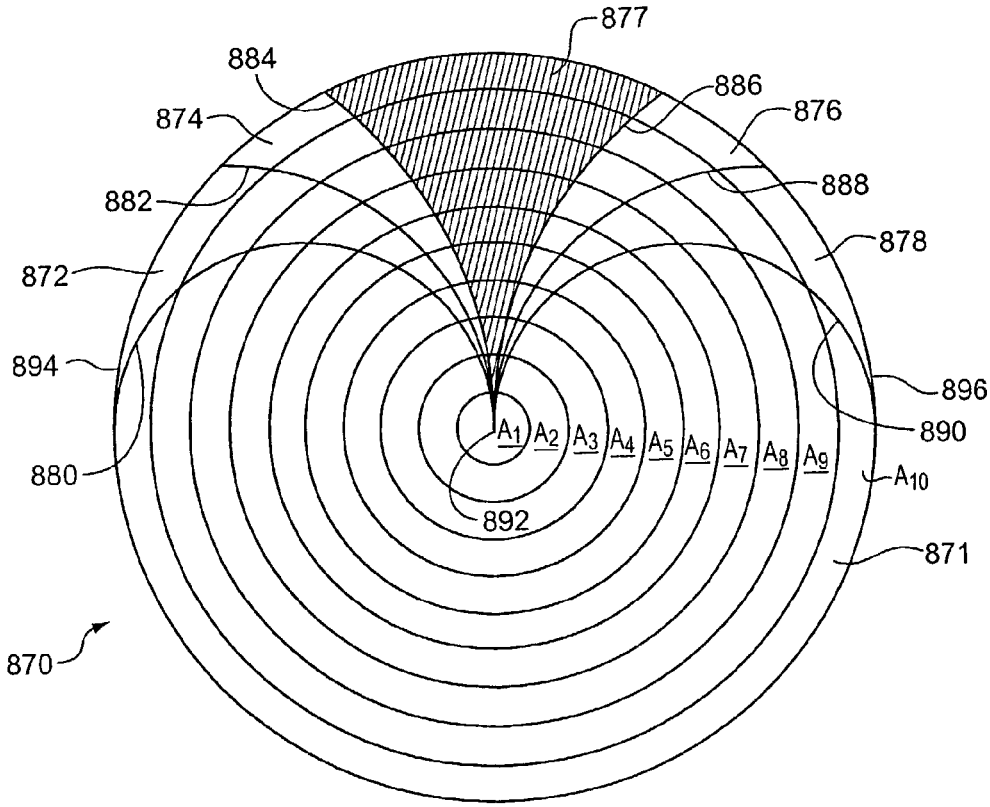
FIG. 11 depicts yet another electrochemical cell having a shield formed as a semi-iris or bat-wing configuration.

The shields may take on any shape, including that of bars, circles, ellipses and other geometric designs. FIG. 11 depicts an electrochemical reactor 870 that is identical to electrochemical reactor 800, except for differences between the shields. FIG. 11 is a bottom view of cell 870 including a wafer 871, which functions as the cell cathode and is masked with shields 872, 874, 876, 877 and 878, respectively, having pairs of curved sides 880, 882, 884, 886, 888, and 890 extending from the center of wafer 871 to the edges of wafer 871. Curved sides 880 and 890 have a radius of curvature of about six inches. Curved sides 880 and 890 each have an inner end 892 that, as depicted, is aligned with the center of wafer 871, but may be shifted in any radial or vertical direction, e.g., to radial distances $A_1$ through $A_{10}$. Outer ends 894 and 896 of curved sides 880 and 890 are aligned with the radially outboard edge of wafer 871. The line connecting to inner end 892 and outer end 894 of curved side 880 and the line connecting to inner end 892 and outer end 896 of curved side 890 form an angle of about 180°.

Curved sides 882 and 888 have a radius of curvature of about 8.4 inches for a 200 mm wafer. Curved sides 882 and 888 have inner and outer ends similar to the inner and center ends of curved sides 880 and 890, except that the lines connecting the inner end and the outer end of each curved side form an angle of about 90°. Curved sides 884 and 886 have a radius of curvature of about 14.4 inches. Similarly, for curved sides 884 and 886, the lines connecting the inner end and the outer end of each curved side form an angle of about 60°. Shields having this type of shape are referred to herein as semi iris arc shields with curved sides.

Figure 12:
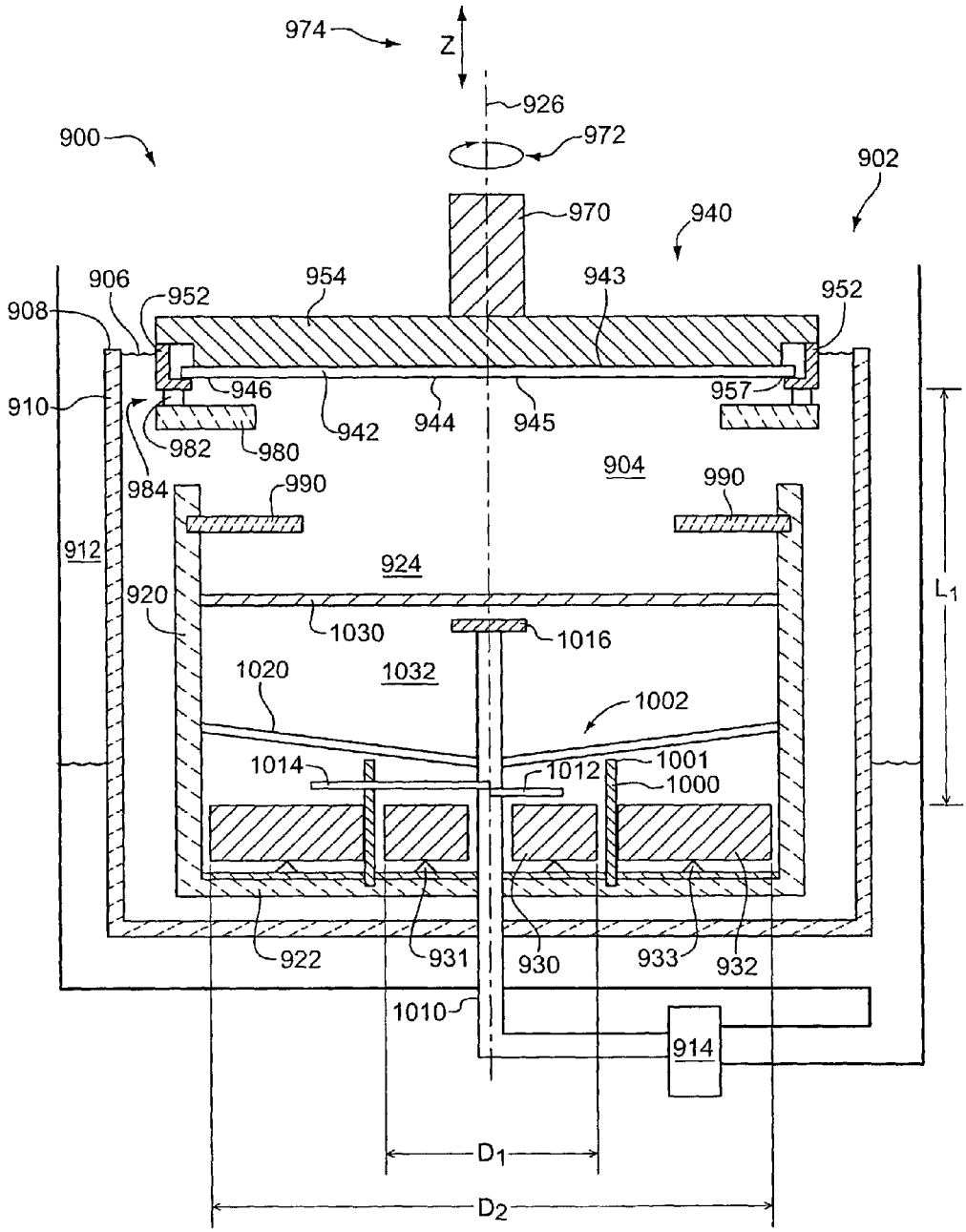
FIG. 12 depicts in schematic form another apparatus in accordance with the invention having a diffuser shield and an insert shield.

FIG. 12 depicts in schematic form an apparatus 900 in accordance with the invention. A first, main plating bath container 902 contains a conventional electroplating bath 904 comprising electrolytic plating fluid. First cylindrical container wall 910 having a top 908 determines plating bath height 906 when plating bath 904 completely fills first plating bath container 902. Container wall 910 functions as an overflow weir. During typical operation, plating fluid overflows weir 910 into a second container 912, concentric with main plating bath container 902 and plating bath 904, where it is collected and processed by central bath control 914, as in current Saber XT models, commercially available from Novellus Systems, Inc., San Jose, Calif. In this manner, bath height 906 is maintained.

Cylindrical anode chamber wall 920 and anode chamber bottom 922 define the sides and bottom of anode chamber 924. Anode chamber wall 920 and bottom 922 are constructed essentially with electrically insulating material, such as a dielectric plastic. Anode chamber 924 is substantially centered about the geometric central axis of apparatus 900, indicated by dashed line 926. Inner concentric anode electrode 930 is located at the bottom of anode chamber 924, substantially centered about central axis 926. Inner concentric anode 930 is substantially disk-shaped with a central hole. In an electroplating apparatus designed for 300 mm wafers, inner concentric anode 930 has a thickness in its axial direction in a range of about 35 mm and an outside diameter, $D_1$, of about 127 mm. Inner concentric anode 930 is supported on the bottom of anode chamber 924 by electrically-conductive inner anode connector 931. Outer concentric anode electrode 932 is located at the bottom of anode chamber 924, concentric with inner anode 930 about central axis 926. Outer concentric anode 930 has an outside diameter, $D_2$, of about 300 mm and an axial thickness similar to the thickness of inner concentric anode 930. Outer concentric anode 932 is supported on the bottom of anode chamber 924 by electrically-conductive outer anode connector 933. Each of anode connectors 931, 933 is separately connected (or both are connected in parallel) to a positive terminal of a power supply (not shown). This allows separate control of electrical current and power to each of concentric anodes 930, 932.

Electroplating bath 904 is a conventional bath that typically contains the metal to be plated together with associated anions in an acidic solution. In the case of an anodic treatment (electropolishing) apparatus, the bath may contain the metal being removed so that the counter electrode (cathode) is plated with the metal being removed (polished) so as to keep the bath overall chemically balanced. In one preferred embodiment, a polishing bath for copper contains between 0.02 and 1.0 moles per liter (M/L) cupric ions and 25 to 85% phosphoric acid (by weight).

Electroplating apparatus 900 further includes a substrate wafer holder 940. Substrate holder 940 holds integrated circuit substrate wafer 942. Wafer 942 has a wafer backside 943 and a front plating surface 944, typically containing a conductive seed layer, which front surface 944 is treated in accordance with the invention. Substrate wafer 942 and front surface 944 have a center zone 945 and an edge zone 946 near the outside edge 947 of the wafer. Preferably, substrate holder 940 is a clamshell-type wafer holder, as described in commonly-owned U.S. Pat. No. 6,156,167 issued Dec. 5, 2000 to Patton et al., which is hereby incorporated by reference. Clamshell substrate holder 940 as depicted in FIG. 12 comprises a cup 952 and a cone 954. Cup 952 contains a cavity into which wafer substrate 942 is placed. Cup 952 also contains a compliant O-ring seal and a set of electrical contacts for electrically connecting the negative terminal of a power source to the conductive seed layer at the edge of wafer substrate 942. FIG. 13 depicts in schematic form the disposition of wafer substrate 942 in cup 952 of a clamshell substrate holder 940. Cup 952 is fitted with a compliant seal 956, which forms a seal at wafer/seal interface 957 between cup 952 and plating surface 944. Electrical contacts 960 make electrical connection with seed layer 962 near wafer substrate edge 947. By forming a seal between cup 952 and plating surface 944 in edge zone 946 of plating surface 944, compliant seal 956 prevents the plating fluid from entering a dry region 966 of cup 952 and contaminating contacts 960, the dry wafer periphery at edge 947 and wafer backside 943. In this specification, the terms "dry", "unexposed" and similar terms generally refer to the part of wafer edge 947 not exposed to plating bath 904 during electroplating operations. Cone 954 (FIG. 12) is lowered and pressed onto cup 952 after wafer 942 is in place. Cup 952 and cone 954 are clamped together by pulling a vacuum between them. Cone 954 is attached to rotatable spindle 970. A motor (not shown) drives spindle 970. This provides rotation of substrate holder 940 and wafer substrate 942 around central axis 926, as indicated by rotation arrow 972. The distance between concentric anodes 930, 932 and plating surface 944 defines a substrate height $L_1$. Substrate holder 940 is partially submerged in plating bath 904 during electroplating operations so that electrolytic plating fluid wets plating surface 944 of substrate 942, but does not wet the upper portions of substrate holder 940. Preferred embodiments in accordance with the invention also provide dynamic translation of wafer holder 940 up or down in the z-direction indicated by arrows 974 during electroplating operations to vary dynamically substrate height $L_1$.

As depicted in FIG. 12, preferred embodiments in accordance with the invention include an insert shield 980 between anode chamber 924 and wafer substrate 942 for shielding edge zone 946 of substrate 942. Typically, insert shield 980 is supported by cup 952 and is attached to cup 952 by spacers 982. Insert shield 980 and substrate holder 940 define a flow gap 984 through which plating fluid passes. As explained below, the size and shape of the insert shield 980 and the size and shape of flow gap 984 influence the flow pattern and current flux through the electrolyte to edge zone 946 during electrochemical treatment of substrate 942. Preferably, spacers 982 are variable during electroplating operations for dynamically varying flow gap 984.

Preferred embodiments in accordance with the invention further include a diffuser shield 990 located between concentric anode electrodes 930, 932 and substrate 942. Preferably, diffuser shield 990 is located in anode chamber 924. Typically, diffuser shield 990 has a substantially annular shape. As depicted in the embodiments of FIG. 12, diffuser shield 990 is supported in anode chamber wall 920. Preferably, the shielding area of a diffuser shield is dynamically variable during electroplating operations (or other electrochemical treatment) on substrate 942. As depicted in FIG. 6, a diffuser shield in accordance with certain embodiments of the invention comprises a plurality of annular rings rotatable about central axis. Each of the rings is configured to have an open area and a closed area. Rotation of one or more rings relative to the other rings changes the degree of overlapping of the respective open areas and closed areas of the rings. As a result, the shielding surface area of the shield is changed. Therefore, an apparatus 900 in accordance with the invention preferably includes an actuator (not shown) for dynamically rotating at least one of the rotatable rings of a diffuser shield during electroplating operations.

Wafer 942 may be any semiconducting or dielectric wafer, such as silicon, silicon-germanium, ruby, quartz, sapphire, and gallium arsenide. Prior to electroplating, wafer 942 is preferably a silicon wafer having a copper seed layer on a Ta or TiN barrier layer. Alternatively, substrate 942 may be a magnetic disk or other substrate having a metal film that is treating surface 944.

Insert shield 980, diffuser shield 990, inner wall 1000 and anode container wall 920 comprise materials that resist attack by electrolytic plating fluid in bath 904. These materials are preferably high dielectrics or a composite material including a coating of a high dielectric to prevent electroplating of metal onto the shields or walls due to the induced variation in potential depending on their positions within the bath. For example, various plastics may be used, including polypropylene, polyethylene, and fluoro-polymers, especially polyvinylidine fluoride, or ceramics such as alumina or zirconia.

As shown in FIG. 12, preferred embodiments of apparatus 900 further comprise a dielectric inner focusing wall 1000 located between inner concentric anode 930 and outer concentric anode 932, and having a wall height 1001. Inner focusing wall 1000 defines inner focusing cylinder 1002, having an inner focusing cylinder height defined by wall height 1001. Inner focusing cylinder 1002 functions to focus the current flux from inner concentric anode 930 towards the center of wafer substrate 942 during electroplating operations (or other electrochemical treatment). Similarly, inner focusing wall 1000 and anode chamber wall 920 influence the current flux from outer concentric anode 932 and focus it towards substrate 942.

For example, a decrease in the diameter of anode chamber wall 920 or an increase in substrate height $L_1$ leads to greater resistance for electroplating current to pass from the anode through electrolyte plating bath 904 to wafer edge 946. In particular embodiments in accordance with the invention, the various dimensions, such as $D_1$, $D_2$, and $L_1$, are selected and optimized according to various factors, including, for example: plating bath factors, such as conductivity and reactive properties of its organic additives; the initial seed thickness and profile; and damascene feature density and aspect ratios.

As depicted in FIG. 12, inlet manifold 1010 carries plating fluid into anode chamber 924. Plating fluid flows through inlet flutes 1012 to irrigate inner anode focusing cylinder 1002 and inner concentric anode 930. Plating fluid also flows through inlet flutes 1014 to irrigate outer concentric anode 932. Plating fluid also flows into anode chamber 924 through top hatless inlet nozzle 1016 located at the end of inlet manifold 1010. In preferred embodiments, a porous anode membrane 1020 is disposed in anode chamber 924 above concentric anodes 930, 932. Anode membrane 1020 is substantially resistive to flow and serves to distribute the flow of electrolytic plating fluid. In preferred embodiments, height 1001 of inner anode focusing wall 1000 is slightly lower (2 mm–3 mm) than anode membrane 1010. A preferred embodiment further includes porous flow distribution membrane 1030 located above nozzle 1016. Anode membrane 1020 and flow distribution membrane 1030 define a diffuser subchamber 1032. Plating fluid flows into flow distribution subchamber 1032 through inlet nozzle 1016, which substantially redirects fluid flow from an axial to a radial direction with respect to center axis 926. Substantially all of the plating fluid that enters flow distribution chamber 1032 flows out of chamber 1032 through porous flow distribution membrane 1030, which creates substantially azimuthally uniform flow of plating fluid directed at wafer substrate 942 above.

An apparatus 900 is used in accordance with the invention for electropolishing by substituting electropolishing fluid into bath 904, and reversing polarities such that treating surface 944 functions as an anode, and electrodes 930, 932 function as cathodes. Similarly, the apparatus is useful generally for electrochemical treatments that remove metal electrochemically from a substrate surface by providing an appropriate electrolytic fluid for electrochemically removing metal into bath 904.

FIG. 14 shows an embodiment of a diffuser shield in accordance with the invention. Diffuser shield 1400 in FIG. 14 has an inner annular ("lip") diameter 1402 of 9.5 inches, and an inner notch diameter at 1404 of 11.5 inches. Diffuser shield 1400, referred to as an alpha-style shield below, is characterized by approximately rectangular open areas, or notches, 1410. Diffuser shield 1400 comprises two annular rings, ring "A" and ring "B". Ring A has an annular lip 1420 defining a circular open area 1430 having lip diameter 1402. Similarly, ring B has an annular lip 1421 defining a circular open area 1431 having lip diameter 1402. Each ring also has open indents in its lip, each indent approximately two times the area of notches 1410 depicted in FIG. 14. The indents in the lip of ring A define closed area tabs A, as indicated in FIG. 14. The indents in the lip of ring B define closed area tabs B, as indicated in FIG. 14. FIG. 14 indicates the radial arc length A° corresponding to each regularly-spaced indent of ring A, and an arc length B° corresponding to each regularly-spaced indent of ring B. As depicted in FIG. 14, tabs A of ring A overlap approximately one-half of the open area of indents of ring B. Similarly, tabs B of ring B overlap approximately one-half of the open area of indents of ring A. The two rings are aligned substantially about a central axis one on top of the other and are operably connected so that rotation of one or more rings increases or decreases the notched open space 1410 of shield 1400. For example, when ring B is rotated in either direction so that tabs B overlap tabs A, then the open area of notches 1410 approximately doubles. Thus, rotation of one or more of rings A, B, typically on the order of several arc degrees, varies the closed and open areas of the shield, and thereby the degree of shielding of a wafer. Similar shields are constructed using two or more rings, in which dimensions and shapes are selected to optimize shielding properties. As depicted in FIG. 14, alpha shield 1400 has a nominal "100 percent open" notched area 1410. Rotation of the cooperating rings of shield 1400 to double the open notched area results in a nominal "200 percent open" shield. In accordance with the invention, an actuator selectively rotates one or more rings relative to another ring during electroplating operations to vary dynamically the closed and open areas of the shield. It should be noted that a wafer substrate is usually rotated during electrochemical treatment operations in accordance with the invention. Therefore, the shielding of a substrate surface by closed areas of lips 1420 is time averaged over a period of time related to the rotational speed of the substrate and the open notched areas 1410.

Those skilled in the art will understand that the preferred embodiments described above may be subjected to apparent modifications without departing from the true scope and spirit of the invention. The inventors, accordingly, hereby state their intention to rely upon the Doctrine of Equivalents, in order to protect their full rights in the invention.

We claim:

1. A method of performing electrochemical operations, including electroplating and electropolishing, in an electrochemical reactor with use of an inflatable bladder to shield a portion of surface area of an object from applied field to improve control of thickness profile, said method comprising:

retaining an object between a cathode and an anode in an electrochemical reactor to present a surface of said object for electrochemical reaction;

applying an electric field by flowing current through an electrolyte between said cathode and said anode in said electrochemical reactor; and dynamically inflating or deflating an inflatable bladder during an electrochemical operation to shield a corresponding portion of surface area of said surface from a portion of said applied electric field.

2. A method as in claim 1, further comprising rotating said object.

3. An apparatus having a variable field-shaping capability for use in electropolishing a surface of a substrate, comprising:

a container for holding electrolytic fluid;

a cathode disposed in said container;

a substrate holder configured to present a surface of a substrate for electrochemical reaction;

a shield disposed in said container between said cathode and said substrate holder, said shield configured for shielding a portion of said surface of said substrate; and a means, operable during electropolishing operations, for dynamically varying a parameter selected from the group consisting of: a quantity of shielded surface area of a substrate, a distance separating said shield from said substrate holder, a distance separating said substrate holder from said cathode, and combinations thereof.

4. An apparatus as in claim 3, further comprising means for rotating said substrate holder.

5. An apparatus as in claim 3 wherein said means for dynamically varying a parameter includes a shield having an aperture and means for changing a size of said aperture.

6. An apparatus as in claim 5 wherein said means for changing a size of said aperture includes a mechanical iris defining said aperture.

7. An apparatus as in claim 5 wherein said means for changing a size of said aperture includes a strip having a plurality of different size openings.

8. An apparatus as in claim 3 wherein said means for dynamically varying a parameter includes means for shifting said shield along said electrical pathway to vary a distance separating said substrate holder and said shield.

9. An apparatus as in claim 8 wherein said means for shifting said shield along said electrical pathway to vary a distance between said substrate holder and said shield includes a stepper motor-actuated screw assembly.

10. An apparatus as in claim 3 wherein said means for dynamically varying a parameter includes a wedge shield.

11. An apparatus as in claim 10 including means for varying a position of said wedge shield with respect to said substrate holder.

12. An apparatus as in claim 11 wherein said means for varying a position of said wedge shield with respect to said substrate holder includes means for varying a coordinate selected from the group consisting of X coordinates, Y coordinates, Z coordinates, and combinations thereof.

13. An apparatus as in claim 11 wherein said means for varying a position of said wedge shield with respect to said substrate holder includes means for varying an angle of said wedge shield relative to said substrate holder.

14. An apparatus as in claim 3 including a computer operably configured to control operation of said means for dynamically varying said parameter to provide a uniform electropolishing rate across a wafer in said substrate holder.

15. An apparatus as in claim 14 wherein said computer is configured to actuate said means for dynamically varying said parameter responsive to changes in current density at said substrate holder.

16. An apparatus as in claim 15 wherein said computer is operably configured to actuate said means for dynamically varying said parameter to provide a substantially constant current density across a wafer in said substrate holder.

17. A method of electropolishing a surface of a substrate, comprising:

providing electrolytic fluid in a container, said container containing a cathode, and said container further containing a shield;

immersing a substrate held in a substrate holder into said electrolytic fluid, such that said shield is disposed between a surface of said substrate and said cathode;

applying an electric field by flowing current between said surface and said cathode through said electrolytic fluid such that said shield shields a portion of surface area of said substrate from a portion of said applied electric field; and actuating said shield to vary dynamically said applied electric field around said substrate holder during electropolishing operations, wherein said actuating a shield includes actuating said shield during electropolishing operations to vary dynamically a parameter selected from the group consisting of: a quantity of shielded surface area of said substrate; a distance separating said shield from said substrate; a distance separating said substrate from said cathode; and combinations thereof.

18. The method according to claim 17 wherein said shield has an aperture and said actuating said shield includes changing a size of said aperture to vary said quantity of shielded surface area.

19. The method according to claim 18 wherein a mechanical iris defines said aperture and said changing said size of said aperture includes actuating said mechanical iris.

20. The method according to claim 18 wherein said shield is a shiftable strip having a plurality of different size openings and said changing a size of said aperture includes shifting said strip relative to said wafer.

21. The method according to claim 17 wherein said actuating said shield includes shifting said shield to vary a distance between said substrate holder and said shield.

22. The method according to claim 17 including rotating said wafer relative to said shield during electropolishing operations.

23. The method according to claim 17 wherein said actuating said shield includes actuating a wedge shield.

24. The method according to claim 23 wherein said actuating said wedge shield includes varying a coordinate of said wedge shield selected form the group consisting of X coordinates, Y coordinates, Z coordinates, and combinations thereof, concomitant with rotation of said wafer.

25. The method according to claim 24 wherein said varying a coordinate of said wedge shield with respect to said substrate holder includes varying an angle of said wedge shield.

26. The method according to claim 17 wherein said actuating said shield is performed responsive to changes in current density at said substrate holder.

27. The method according to claim 26 wherein said actuating said shield is performed to provide a substantially constant current density at said substrate holder.

* * * * *